US008336265B2

(12) United States Patent
Vosburg

(10) Patent No.: US 8,336,265 B2
(45) Date of Patent: Dec. 25, 2012

(54) REVERSIBLE SLIDING GLASS DOOR

(76) Inventor: Mary Lou Vosburg, Las Vegas, NV (US)

( * ) Notice: Subject to any disclaimer, the term of this patent is extended or adjusted under 35 U.S.C. 154(b) by 0 days.

(21) Appl. No.: 13/349,420

(22) Filed: Jan. 12, 2012

(65) Prior Publication Data

US 2012/0227329 A1 Sep. 13, 2012

Related U.S. Application Data

(63) Continuation of application No. 12/387,739, filed on May 8, 2009, now abandoned.

(51) Int. Cl.
*E06B 3/32* (2006.01)

(52) U.S. Cl. ..... 52/204.51; 49/404

(58) Field of Classification Search ..... 49/382, 49/404; 52/204.51
See application file for complete search history.

(56) References Cited

U.S. PATENT DOCUMENTS

| | | | | | |
|---|---|---|---|---|---|
| 1,596,952 | A | * | 8/1926 | Smith | 359/854 |
| 2,847,726 | A | * | 8/1958 | Frick | 52/207 |
| 3,253,366 | A | * | 5/1966 | Kelleher | 49/404 |
| 3,304,658 | A | * | 2/1967 | Kreger | 49/425 |
| 3,859,754 | A | | 1/1975 | Budich | |
| 4,098,027 | A | * | 7/1978 | Crance | 49/504 |
| 4,227,346 | A | | 10/1980 | Kubik | |
| 4,799,332 | A | * | 1/1989 | Haas | 49/408 |
| 4,944,118 | A | | 7/1990 | Biro | |
| 4,958,468 | A | * | 9/1990 | Nolan | 52/204.51 |
| 5,274,955 | A | | 1/1994 | Dallaire | |
| 5,379,824 | A | * | 1/1995 | Carvalho | 160/90 |
| 5,634,508 | A | * | 6/1997 | Herbst | 160/371 |
| 5,678,366 | A | * | 10/1997 | Nambo et al. | 52/207 |
| 5,687,519 | A | * | 11/1997 | Bruchu | 52/213 |
| 5,832,670 | A | * | 11/1998 | Bennett | 49/382 |
| 5,887,391 | A | * | 3/1999 | Shoup | 52/202 |
| 5,894,706 | A | * | 4/1999 | Herbst | 52/782.1 |
| 6,067,754 | A | * | 5/2000 | Bellart | 49/453 |
| 6,311,439 | B1 | * | 11/2001 | Arcati et al. | 52/204.51 |
| 6,688,063 | B1 | * | 2/2004 | Lee et al. | 52/455 |
| 7,007,439 | B1 | * | 3/2006 | Larson et al. | 52/784.16 |
| 7,117,639 | B2 | * | 10/2006 | Abdella et al. | 49/382 |
| 7,246,466 | B2 | | 7/2007 | Turner | |
| 7,555,871 | B1 | | 7/2009 | Neal | |
| 7,637,058 | B2 | | 12/2009 | Lai | |
| 7,661,226 | B2 | * | 2/2010 | Kibbel et al. | 49/382 |
| 7,707,778 | B2 | * | 5/2010 | Petta et al. | 49/504 |
| 7,707,779 | B2 | | 5/2010 | Petta | |
| 2002/0032995 | A1 | | 3/2002 | Siudzinski | |
| 2002/0124494 | A1 | * | 9/2002 | Zen | 52/204.1 |

* cited by examiner

*Primary Examiner* — Jerry Redman
(74) *Attorney, Agent, or Firm* — Kenehan & Lambertsen, Ltd; John C. Lambertsen

(57) ABSTRACT

This is a design for a sliding glass door that provides the option to choose an opening right to left, or change to an opening left to right at anytime. The outside panel of the door can slide to either end of the opening and lock into place. The inside panel, sliding can slide to either end of the opening.

7 Claims, 8 Drawing Sheets

REVERSIBLE SLIDING GLASS DOOR

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable.

BACKGROUND OF THE INVENTION

This invention relates to the design for the manufacture of sliding glass doors that are used in building, including but not limited to private homes, apartments and commercial building.

Currently, sliding glass doors are manufactured with one half of the door fixed (the outside panel) and one half of the door (inside panel) sliding. There is a choice for a door that opens either right to left or left to right. The choice must be made prior to installation and once chosen, the door is installed to permanently open right to left or left to right. If the opposite opening is desired; the sliding glass door must replaced. This invention provides the design to allow the doorway opening right to left to change to a doorway opening left to right at anytime. This ability to change the access to a room will allow greater flexibility in furniture or equipment arrangements in the room.

BRIEF SUMMARY OF THE INVENTION

The sliding door frame has three tracks, one for the outside panel and one for the inside (door) panel and one on the outside for a screen door. The outside panel can slide to either side of the opening and lock into place. The inside panel can slide from either end of the door frame to open and close for door access to the room or building. The screen door can slide to either end of the opening.

DETAILED DESCRIPTION OF THE INVENTION

Figure 1:
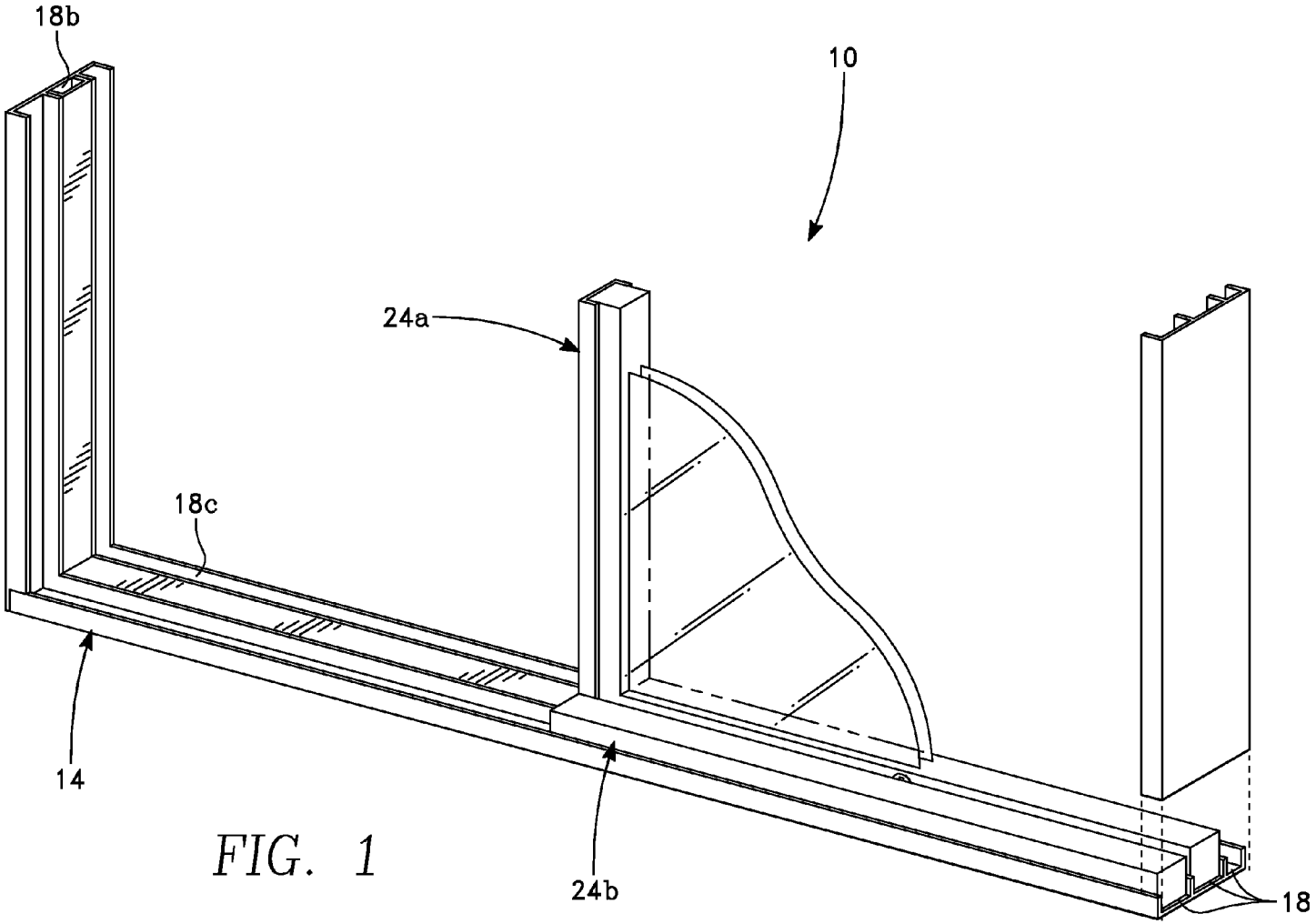
FIG. 1: A partial perspective view with portions exploded, portions broken away, and portions shown in phantom of the door panels and of the three tracks that make up the top, sides, and bottom of the frame.
Figure 2A:
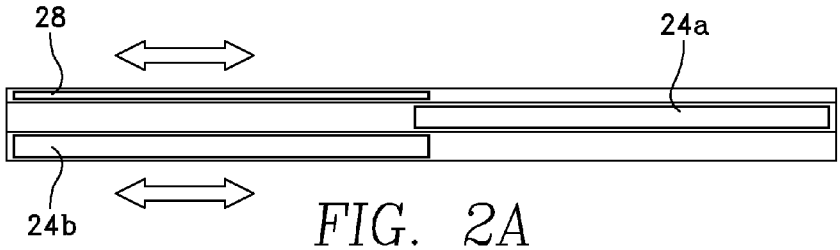
FIG. 2A is a top plan view of the bottom frame showing a screen door and the inner and outer door panels as received within the three tracks in accordance with the present invention.
Figure 2B:
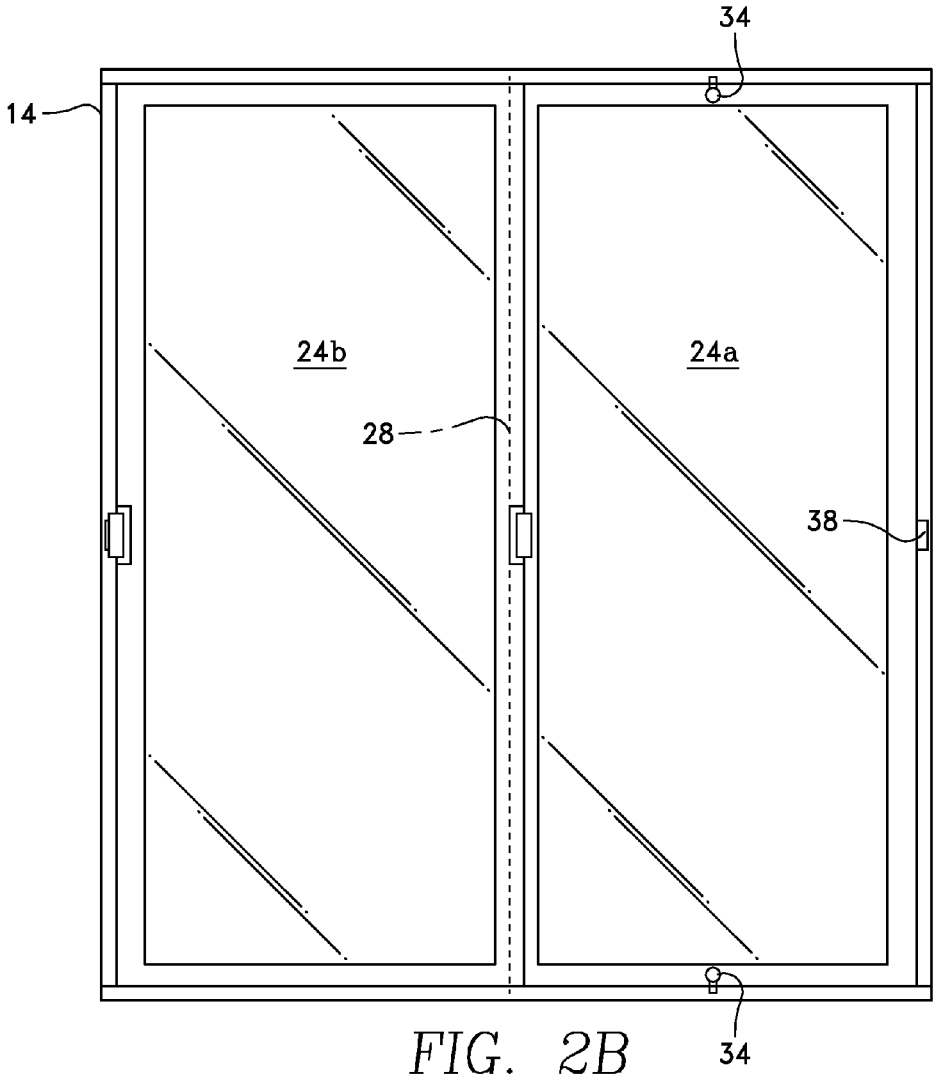
FIG. 2B is a side elevation view, with a portion shown in phantom, of a sliding glass door with the screen door and inner and outer door panels as located in FIG. 2A.

The sliding glass door 10 is comprised of a frame 14 with door tracks 18 that hold two door panels, an outer door panel 24*a* and an inner door panel 24*b*, each covering half of the opening, there is an additional outside track 26 for the sliding screen door 28 (see FIGS. 2A and 2B).

The outer panel 24*a* slides on the outside track 18*b* and locks in place at either end of the opening to provide the security and support of the fixed portion of the sliding glass door assembly. The panel locks to the door frame on the top, bottom and side. The top and bottom track locks 34 can be either deadbolt type locks or clamp type locks (not shown) as would be dictated by the construction material. For example, a deadbolt type lock may work better in a door manufactured in wood, a clamp type lock may work better in an aluminum door. The lock assemble is flush with the inside surface of the panel so as not to obstruct the sliding of the inside door panel. The lock on the side 38 of the panel clamps or hooks to the frame to the secure the panel in position. The locks are the same on each side of the door frame 14.

Figure 3A:
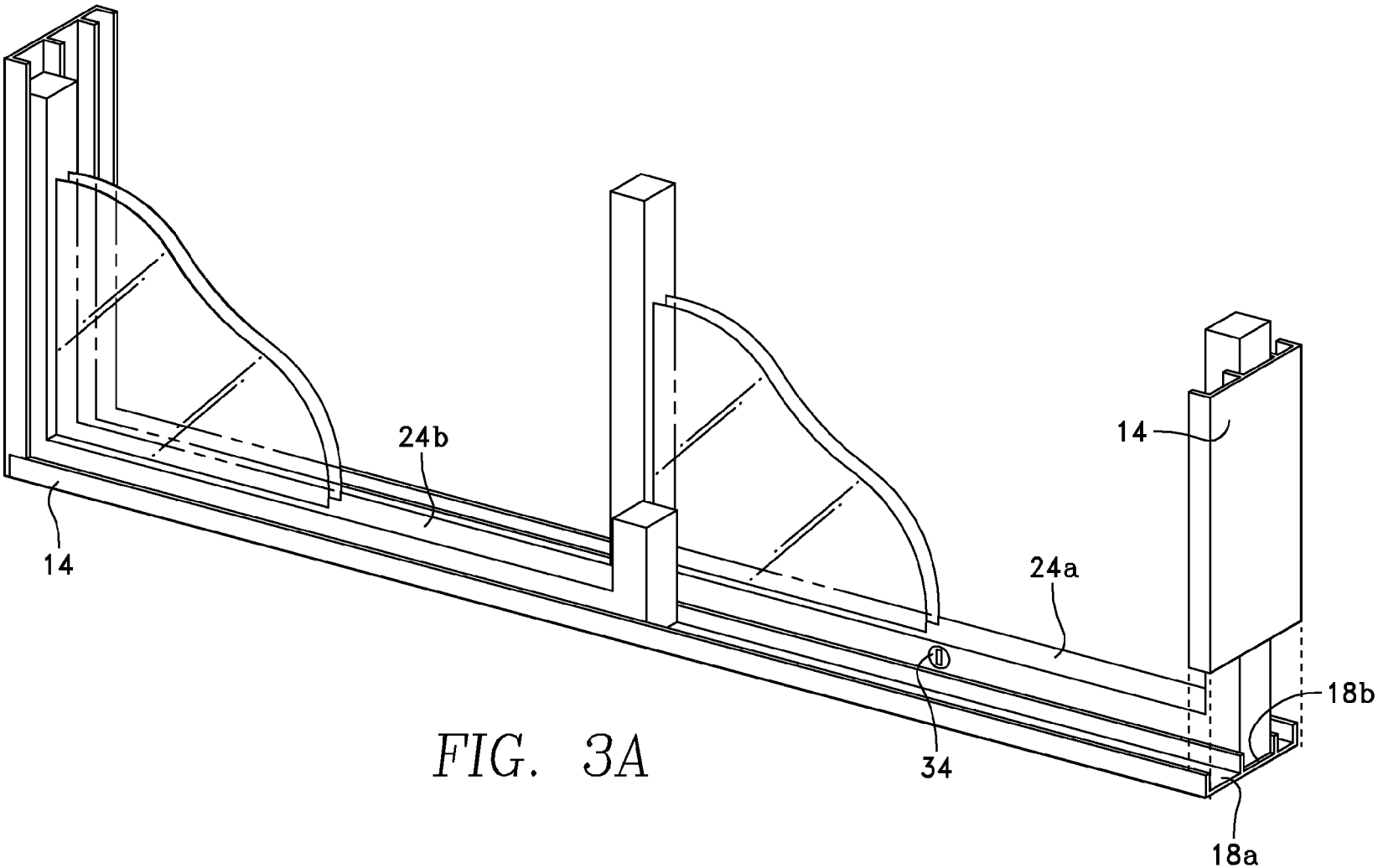
FIG. 3A is a partial perspective view similar to FIG. 1 showing an outer door panel locked in place adjacent the right door frame and an inner door panel in a closed door position adjacent the left door frame in accordance with the present invention.
Figure 3B:
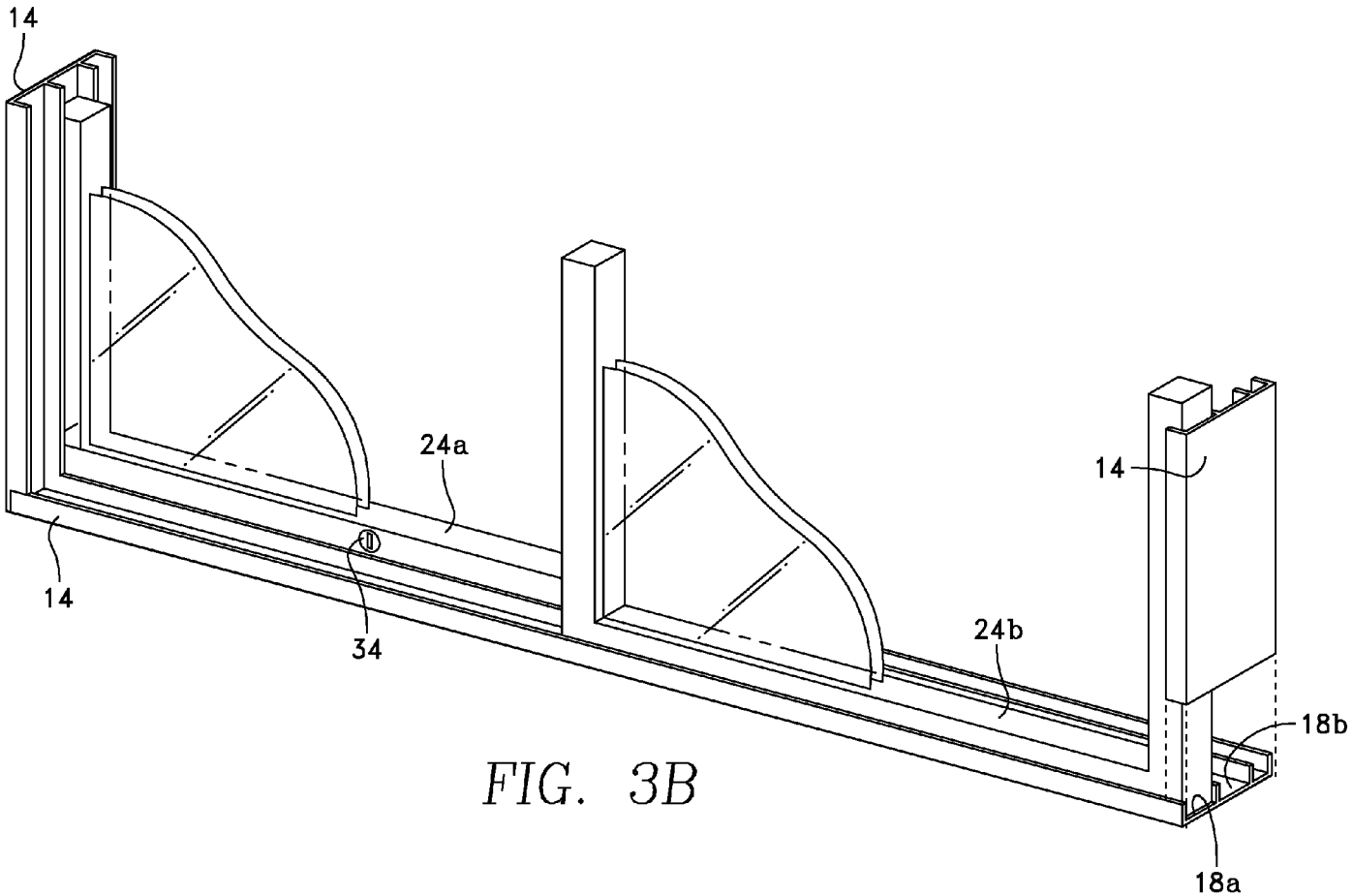
FIG. 3B is a partial perspective view similar to FIG. 1 showing an outer door panel locked in place adjacent the left door frame and an inner door panel in a closed door position adjacent the right door frame in accordance with the present invention.

FIGS. 3A and 3B depict the manner in which the sliding glass door of the present invention may be selectively configured to change on which side: right or left, the sliding doorway opens. In FIG. 3A the outer door panel 24*a* is positioned adjacent the right side of the sliding glass door frame 14 and locked in position using track locks 34 (only one shown). The inside panel slides within the inner track 18*a*, from a locked position in the left door frame to an open position adjacent the right side of the frame 14. The access doorway is thus located at the left side of the sliding glass door (from a position looking out, through the door). In FIG. 3B the outer door panel 24*b* has been positioned to the left side of the sliding glass door frame 14, and the access doorway is now located at the right side of the sliding glass door (again, if looking out through the door).

Figure 4:
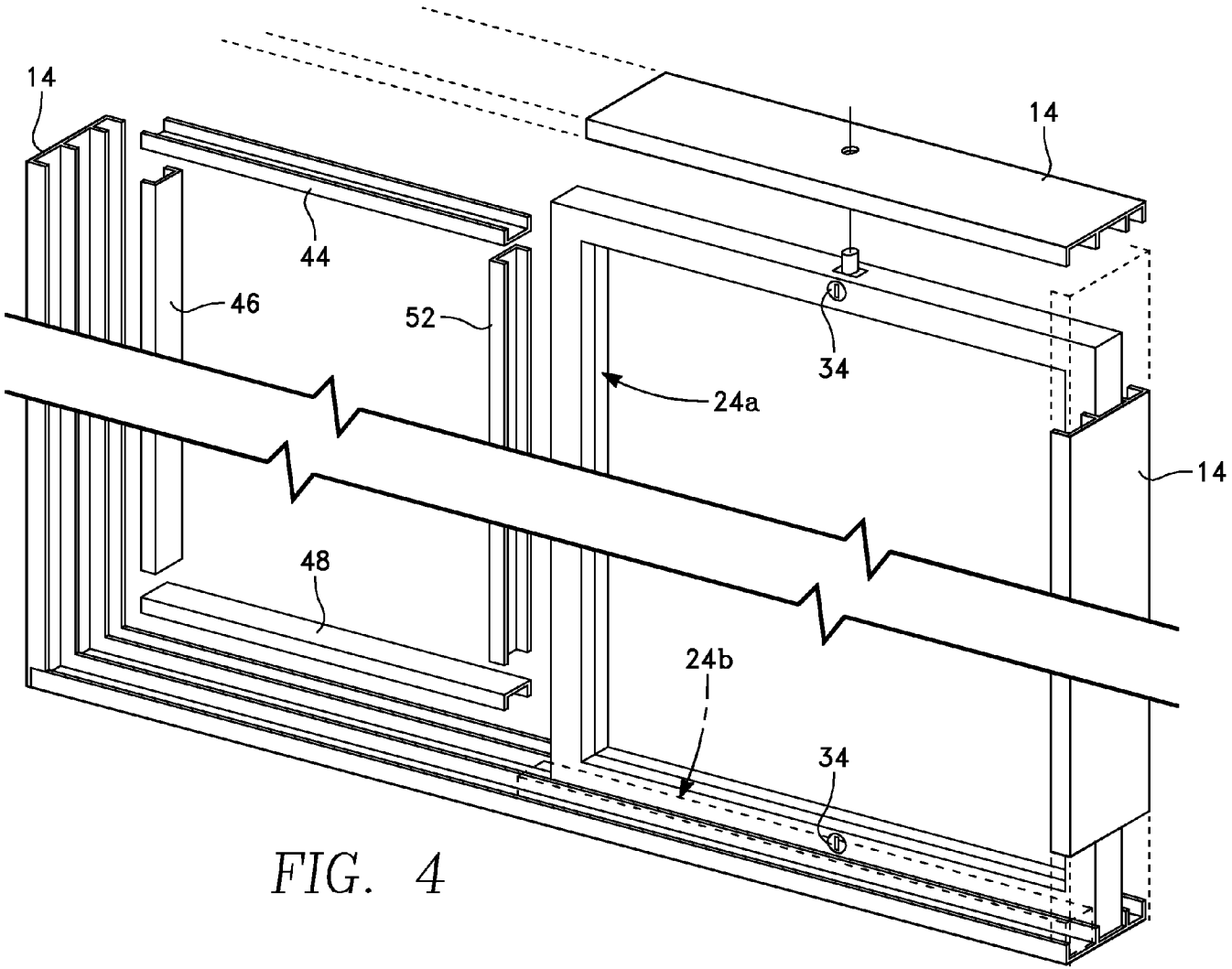
FIG. 4 is a partial perspective view with portions exploded and portions shown in phantom of a sliding glass door frame with an outer door panel locked in place adjacent the right door frame in accordance with the present invention.
Figure 6A:
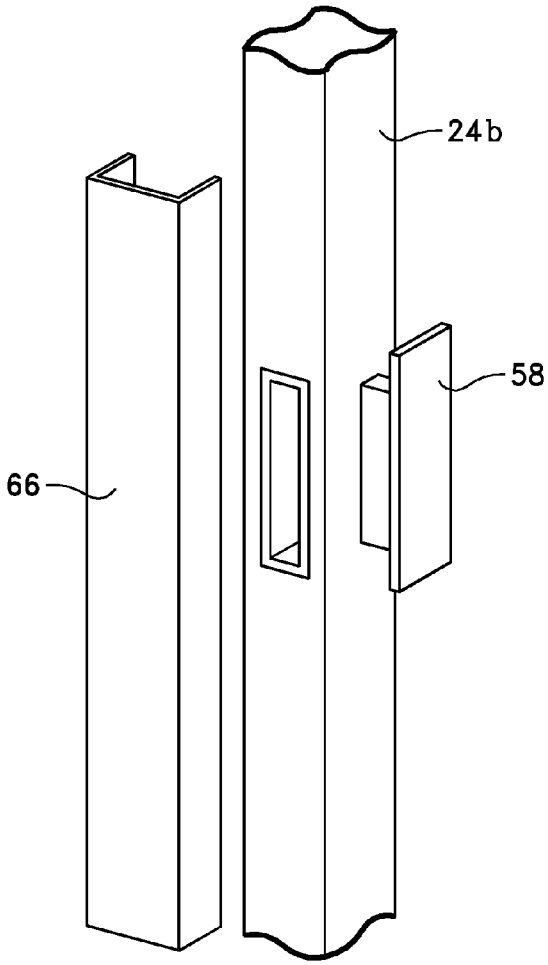
FIG. 6A is a partial perspective and exploded view of an inner door handle and lock assembly and a door end cap in accordance with the present invention.
Figure 6B:
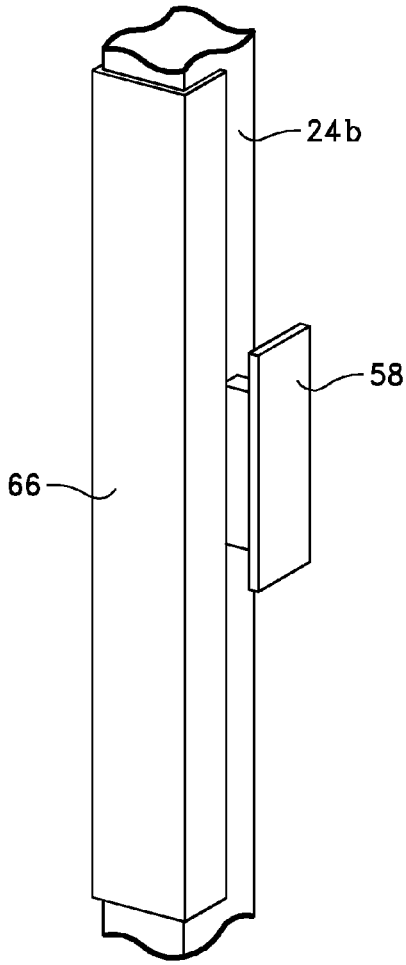
FIG. 6B is a partial perspective view, similar to FIG. 6A, of an inner door handle and lock assembly with a door end cap received thereon in accordance with the present invention.
Figure 7:
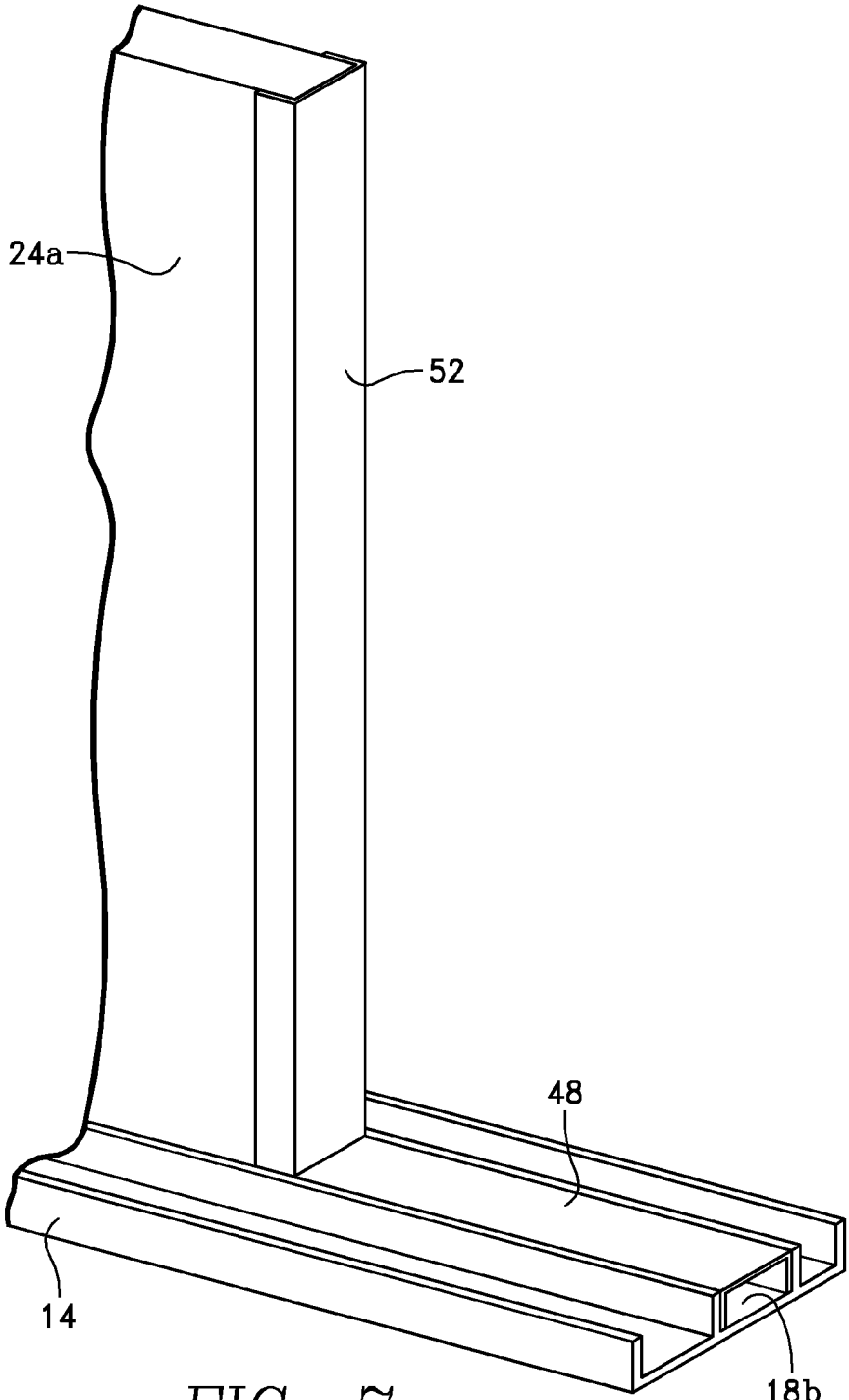
FIG. 7 is a partial perspective view of a U-shaped cap received on an end of an outer door panel and a bottom insert received within a door track in accordance with the present invention.

As is best shown in FIG. 4, inserts cover the outside track 18*b* to provide a finished, level surface for the open half of the door frame and also add to the security of the "fixed" portion of the sliding glass door. The insert consists of four (4) sections that may be separate pieces or connected. The section insert into the top 44, side 46 and bottom 48 track opening (sections 1-3). The insert for sections 1-3 is U-shaped to fit inside and fill the tract. Section 4 is a U-shaped cap 52 that fits over the exposed end of the outer panel 24*a*. On the inside of the U there is a latch that the locks with the lock on the side of the panel 24*a*. When the cap 52 is on the end of the panel 24*a*, it overlaps the end of the insert for the top and bottom track inserts 44, 48. The lock on the sides of the panel latch to the door frame 14 on one side and lock to the insert 52 on the other side, depending on the right or left opening that is chosen (also shown in FIG. 6).

Figure 5A:
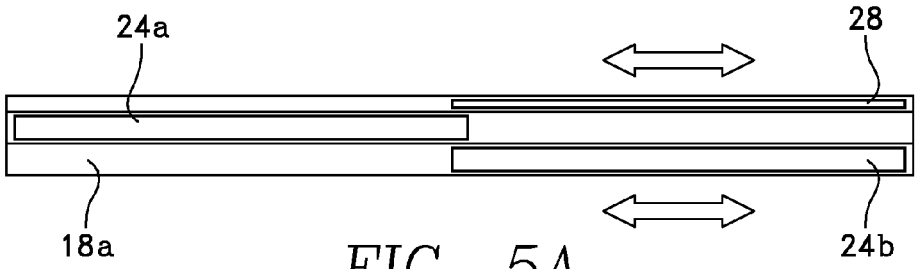
FIG. 5A is a top plan view of the bottom frame, similar to FIG. 2A, showing the screen door and the inner and outer door panels as received within the three tracks and repositioned within the frame in accordance with the present invention.
Figure 5B:
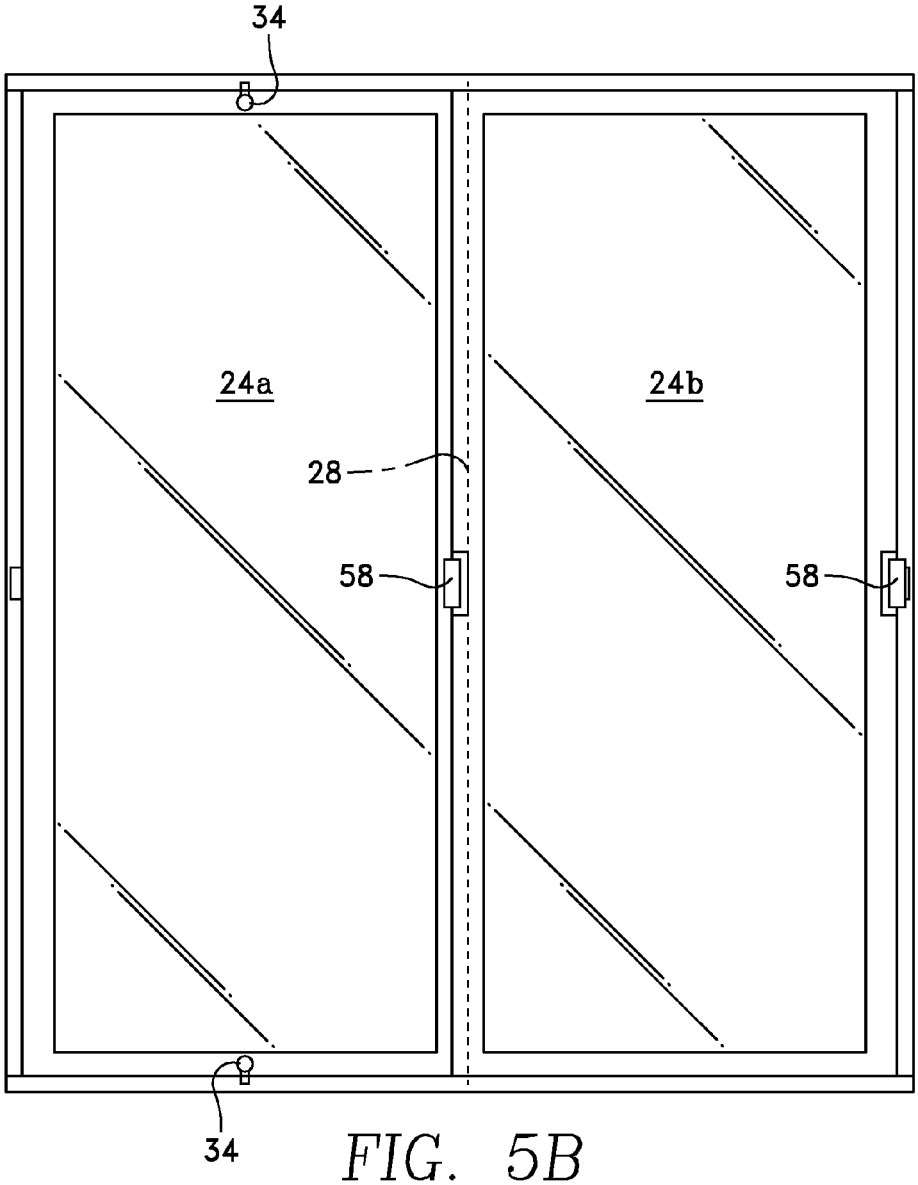
FIG. 5B is a side elevation view, with a portion shown in phantom, of a sliding glass door with the screen door and inner and outer door panels as located in FIG. 5B.

In FIGS. 5A and 5B the inside panel 24*b*, the sliding glass door, slides on the inside track. On the inside, the sliding glass door 24*b* has a handle and lock assembly 58 on both sides. The handles (not shown) on the outside of the inside door panel 24*b* are indented for a flush surface on the outside of the panel to allow the inside door panel 24*b* to slide past the outside panel 24*a*. When the door opens right to left as shown in FIGS. 4A and 4B); the handle 58 on the right, locks to the door frame to lock the door closed; and the handle on the left locks onto a door end cap 66 for the end of the door panel 24*b* (see FIGS. 6A and 6B). When the door opens left to right; the handle on the left, locks to the door frame to lock the door closed; and the handle on the right locks onto the door end cap 66 for the end of the door panel.

The door end cap 66 for the end of the panel is reversible to provide a finished edge to the exposed end of the door. The cap extends to the end of the door the same distance that the door closes into the door frame to close and seal. The weather strip that is on the inside of the door that seals it when closed into the door frame, also seals into the cap.

The invention claimed is:

1. A sliding glass door assembly comprising:

an outer frame of substantially rectangular configuration defining a top extension, a bottom extension, and a pair of lateral extensions, said outer frame having at least two door tracks formed in an interior surface thereof;

an inner door panel slidably received within an inner track formed in said outer frame, said inner door frame including a handle and lock assembly adjacent each lateral edge of said inner door panel, each of said lock assemblies engagable with said outer frame when said inner door panel is slid to the right or slid to the left to lock the sliding glass door closed; and an outer door panel slidably received within an outer track formed in said outer frame, said outer door panel including a pair of track locks releasably engagable with said outer frame at a pair of locations on each side of the outer frame, the pair of track locks locking the outer panel into place on each side of the outer frame to maintain the security of a fixed outer door whereby the selective release and locking of the pair of track locks enables the easy repositioning of the outer panel on each side of the sliding glass door assembly, a doorway opening right to left may be easily changed to a doorway opening left to right and may just as easily be changed back to a doorway opening right to left at any time after the initial installation of the door.

2. The sliding glass door assembly of claim 1, and further comprising a door end cap selectively engagable with one of said pair of lock assemblies on said inner door panel.

3. A sliding closure assembly comprising:

a door frame receivable within a building opening, said door frame of rectangular construction having a top and a bottom extension attached to a pair of lateral extensions and wherein a plurality of door tracks are formed in an interior surface of said door frame, said door tracks extending substantially continuously about said interior surface of said door frame, wherein said plurality of door tracks include an inner door track and an outer door track;

an inner door panel received within said inner door track and alternatively sliding from either end of the door frame to provide a door opening;

an outer door panel received within said outer door track and selectively sliding to either side of the opening; and a pair of locks attached to said outer door panel and a plurality of track lock engagements located in or extending from said outer door track on each side of the door frame, wherein the track lock engagements engage with said pair of locks and the outer door panel to lock the outer door panel in place at either side of the door frame to maintain the security of a fixed outer door panel, whereby the slidable and easily fixed and secured outer door panel permits the side-to-side repositioning of the door opening at any time after installation of the sliding closure assembly.

4. The sliding closure assembly of claim 3, wherein said inner door panel is of substantially rectangular construction and includes a handle and lock assembly adjacent each lateral side of said inner door panel.

5. The sliding closure assembly of claim 4, and further comprising a door end cap selectively engagable with one of said pair of lock assemblies on said inner door panel.

6. The sliding closure assembly of claim 3, wherein a first lock is selectively engagable with said outer door track at said bottom extension of said frame and a second lock is selectively engageable with said outer door track at said top extension of said frame.

7. The sliding closure assembly of claim 3, wherein said sliding closure assembly is a sliding glass door, and wherein a third door track is provided and further comprising a screen door slidably received within said third door track.

* * * * *